United States Patent [19]

Wardell, Jr.

[11] 4,345,812

[45] Aug. 24, 1982

[54] ELECTRON TUBE BASE WITH FLOW CHANNELS THEREIN

[75] Inventor: Myron H. Wardell, Jr., Lititz, Pa.

[73] Assignee: RCA Corporation, New York, N.Y.

[21] Appl. No.: 153,908

[22] Filed: May 28, 1980

[51] Int. Cl.[3] ..... H01R 33/74

[52] U.S. Cl. ..... 339/144 R; 313/318

[58] Field of Search ..... 339/144 R, 144 T, 145 R, 339/145 T; 313/318, 325

[56] References Cited

U.S. PATENT DOCUMENTS

| | | | |
|---|---|---|---|
| 2,498,378 | 2/1950 | Phelps | 250/27.5 |
| 3,278,886 | 10/1966 | Blumenberg et al. | 339/145 |
| 4,076,366 | 2/1978 | Wardell et al. | 339/144 T |
| 4,127,313 | 11/1978 | Marks | 313/318 X |

*Primary Examiner*—Eugene F. Desmond

*Attorney, Agent, or Firm*—E. M. Whitacre; G. H. Bruestle; V. J. Coughlin, Jr.

[57] ABSTRACT

An electron tube base comprises a cup-like housing and a wafer flange extending radially outwardly from an open end of the housing. The base is mounted over the stem of an electron tube with the stem's exhaust tubulation disposed in the housing in a close fit and the stem's lead-in conductors extending through apertures in the flange. The flange has a dielectric-receiving recess around one of the conductors and the internal surface of the housing wall has a pair of open longitudinal channels along which the dielectric material can be force-flowed into the recess from the opposite end of the housing.

5 Claims, 5 Drawing Figures

ELECTRON TUBE BASE WITH FLOW CHANNELS THEREIN

This invention relates to electron tube bases and particularly to those which include a body of dielectric adhesive material molded therein for the purpose of securing the base to the electron tube and increasing the voltage breakdown between the lead-in conductors of the tube.

BACKGROUND OF THE INVENTION

Certain types of electron tubes, e.g. color picture tubes, include a stem structure comprising a glass disk, a circular array of stiff lead-in conductors sealed through the disk, and a central opening through the disk from which an exhaust tubulation extends. It is common practice to attach a base member, usually of some type of plastic material, over the conductors and exhaust tubulation. The base member serves to protect the conductors and the exhaust tubulation, and to provide an indexing means for insertion into a mating socket.

One type of base commonly employed in the picture tube industry is the flanged base which comprises a protector cup or housing disposed over the exhaust tubulation of an electron tube stem, and a flange which extends radially outwardly from the open end of the cup. The flange is abutted against the tube stem and is provided with an array of apertures through which the conductors of the stem are disposed.

U.S. Pat. Nos. 3,278,886-Blumenberg et al. and 4,076,366-Wardell, Jr. et al. disclose flanged type bases, both of which are especially designed for high voltage applications. To this end they incorporate a tubular silo structure which surrounds one of the conductors to which high voltage is applied, and a recess in the flange of the base into which a dielectric adhesive material is molded around the high voltage conductor. Both of these features serve to increase resistance against high voltage breakdown.

In the Blumenberg et al. base, the conductors are spaced outwardly from the exhaust tubulation cup and are thus free-standing. This type of flanged base is sometimes referred to as a wafer base. In the Wardell, Jr. et al. base, the conductors lie flush against the cup in channel-like recess around the periphery of the cup. This type of flanged base is sometimes referred to as a pin-protector base.

The Wardell, Jr. et al. base is provided with a fill hole which communicates with the recess in the flange of the base so that dielectric adhesive can be injected directly into the recess through the fill hole. However, in the case of electron tubes having very small diameter stems there may not be sufficient room in the base for the fill hole. In such cases, bases more like the Blumenberg et al. base are used.

In mounting a base of the Blumenberg et al. type to an electron tube stem, it has been the practice heretofore to simply insert a quantity of dielectric adhesive material directly into the recess of the base and then apply the base to the stem. Since the dielectric adhesive material is applied to the base while it is out of contact with the stem, the result is a messy process. Alternatively, the dielectric adhesive material may be injected through the exhaust tubulation housing. In order for the material to flow along the length of the housing to the recess in the base flange and around the high voltage conductor, sufficient clearance must be provided between the exhaust tubulation and the housing wall, but this conflicts with the need to keep the exhaust tubulation as large as possible in order to facilitate the exhausting of the electron tube therethrough. The result is that often times adequate clearance for good flow of the material along the tubulation is compromised. Furthermore, the concentricity variation between the tubulation and housing may result in the greatest clearance and hence the preferential material flow path being along one side of the tubulation opposite the recess so that the flow path does not communicate with the recess in the base flange. This, of course, results in unpredictable filling of the recess and sometimes no filling at all. On the other hand, if the tubulation and housing are concentric or near concentric, there is no preferential path to material flow and the tubulation may become completely potted in the dielectric adhesive. In such cases if the base is accidentally struck, the transmitted shock to the tubulation may cause it to be fractured.

The present invention is described herein in its preferred embodiment as incorporated in a base-tube combination involving a relatively high voltage lead-in conductor with the adhesive material also being a good high voltage dielectric. However, the invention may be used in base-tube combinations where high voltage insulation is not a concern. The material may then be a simple adhesive without special high dielectric properties.

SUMMARY

A flanged base of the type described is provided with a relatively close fit between the electron tube's exhaust tubulation and the base's housing into which the tubulation is disposed. The housing wall is provided with an internal channel along its length which communicates with the recess in the base's flange, and thereby provides a preferential flow path for adhesive material from the distal end of the housing into the recess.

DESCRIPTION OF PREFERRED EMBODIMENTS

Figure 1:
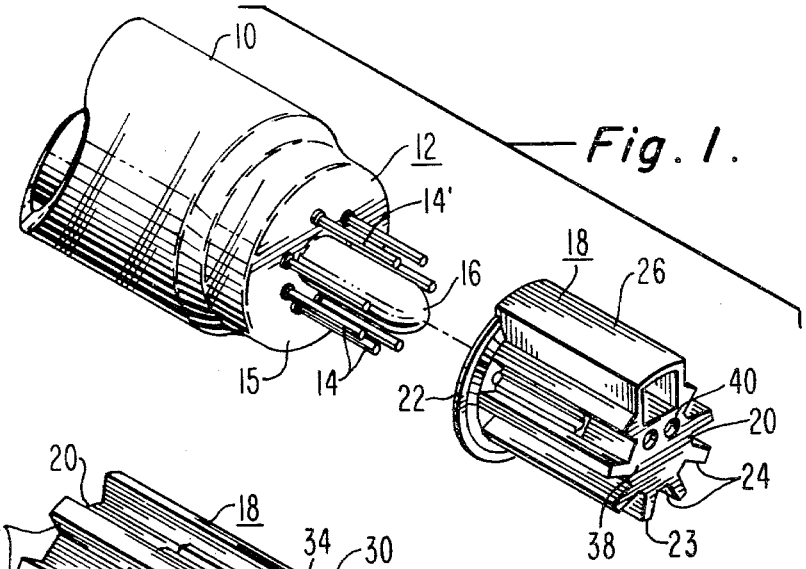
FIG. 1 is an exploded perspective of a stem-containing portion of a cathode ray tube, together with the novel base adapted for mounting thereon.
Figure 2:
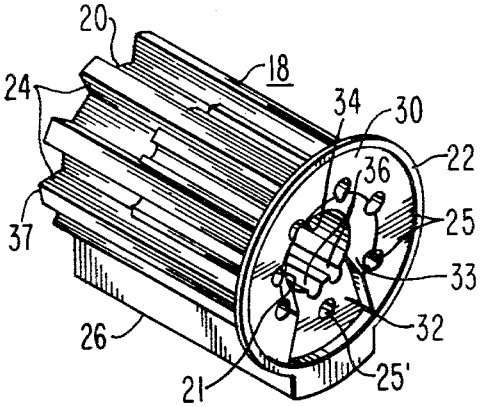
FIG. 2 is a perspective of the novel base as viewed from the end thereof which abuts the stem of the tube of FIG. 1.
Figure 3:
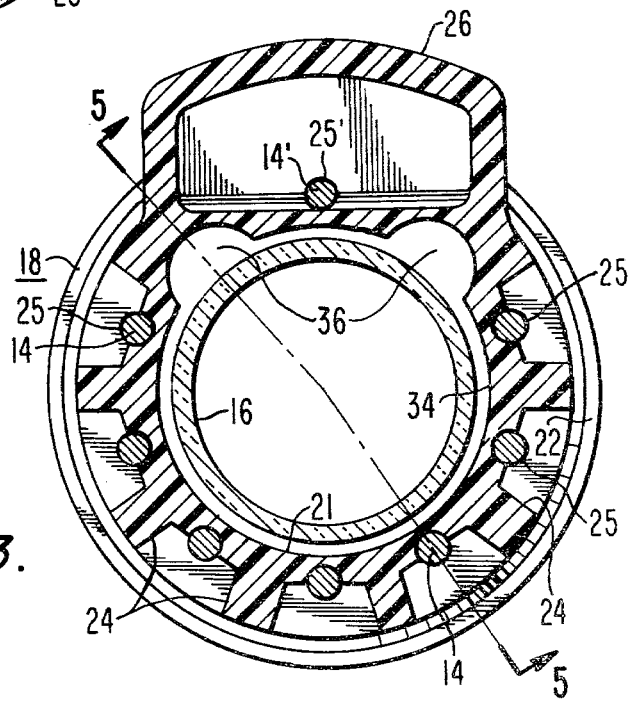
FIGS. 3 and 4 are transverse sections through the assembly of the cathode ray tube stem and novel base, respectively, near the opposite ends thereof.
Figure 4:
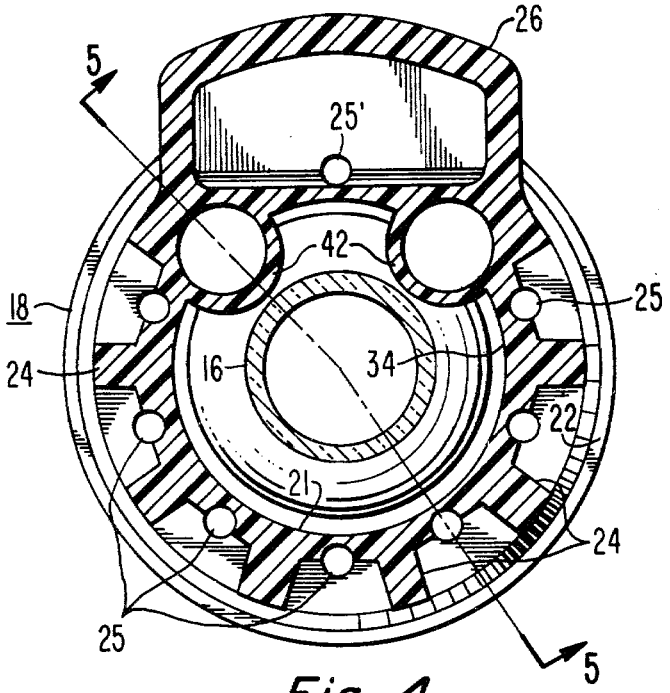
Figure 5:
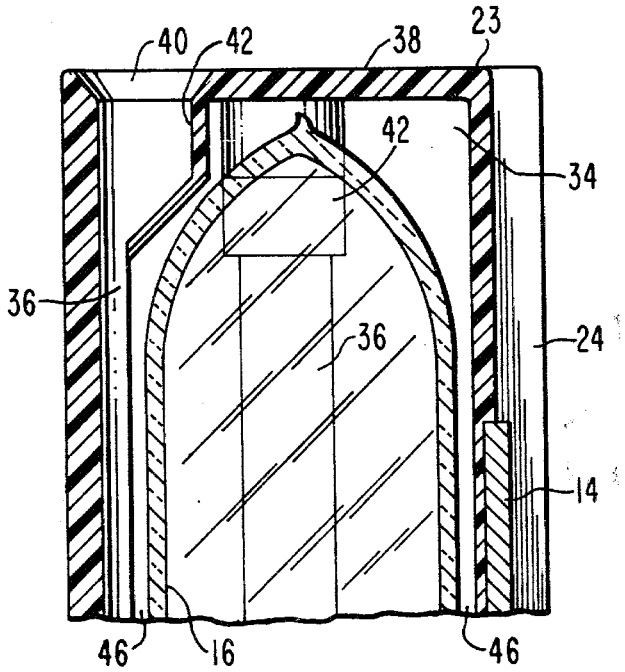
FIG. 5 is a longitudinal section of the base taken along line 5—5 of FIGS. 3 and 4.

Referring to FIGS. 1–5, a glass neck portion 10 of a color picture tube is closed at one end with a stem 12 which includes an array of stiff lead-in conductors 14 sealed through a glass disk 15. The conductors are disposed in a circular array parallel to each other. The stem 12 also includes a closed off exhaust tubulation 16 disposed centrally of the disk 15 over an opening through the disk. A base member 18 is attached to the end of the stem 12.

The base member 18 is of the flanged type and comprises a housing 20 having a cylindrical cavity therein with a full opening 21 at one (proximal) end into which the exhaust tubulation 16 is received. A flange 22 extends radially outwardly from the housing 20 at its opening 21. The housing 20 is closed at its other (distal) end 23 with the exception of a plurality of apertures hereinafter described.

The cylindrical housing 20 fits relatively closely over the exhaust tubulation 16. The outer cylindrical surface of the housing 20 is provided with a series of longitudinal ribs 24 which extend from the flange 22 to the opposite, distal end of the housing 20. The flange 22 is provided with a circular array of apertures 25 therethrough. The circular array of conductors 14 are disposed through the array of apertures 25 and lie one between each pair of adjacent ribs.

The base 18 is also provided with a tubular chamber or silo 26 disposed coextensively along side the housing 20. The silo 26 is closed at one end by the flange 22 and is open at the opposite end. The silo 26 receives therein through one of the apertures 25' in the flange 22 one of the conductors 14' which is intended to have a high voltage applied thereto. The silo 26 serves to provide a greatly increased discharge path from the high voltage conductor contained therein to any one of the adjacent conductors.

The stem-contacting face 30 of the flange 22 is provided with a recess 32 directly beneath the silo 26. The depth of the recess 32 is not critical. It need be only deep enough to allow a thin layer of dielectric material molded therein to form a continuous body that will surround the high voltage lead 14' disposed therein and in the silo 26 at its interface with the glass disk 15. Typically, a depth of about 2.5 mm has been found to be satisfactory. The recess 32 has a lateral dimension sufficient to completely encompass the high voltage conductor 14'. Alternatively, the recess 32 may be wide enough to completely encompass one or more of the other conductors 14 adjacent to the high voltage conductor 14'. The flange is also provided with a chamfer 33 around the opening 21 which extends outwardly to approximately the circular array of conductors 14. This provides an overflow cavity, so that if a quantity of dielectric adhesive material in excess of that needed to fill the recess 32 is forced through the channels 36 and into the recess, it will overflow into the chamfered cavity rather than spilling out between the base and stem or out of the channels and around the tubulation. In this way, the chamfered cavity provides a desired, preferential overflow space for excess material injected through the injection apertures 40.

The internal surface 34 of the housing 20 is provided with a pair of longitudinal grooves or channels 36 which extend from near the distal end 23 of the housing to the recess 32. These channels provide preferential flow paths for viscous dielectric adhesive material injected into the housing at the distal end 23 to flow therefrom and into the recess 32 around the high voltage lead 14'. The flow channels 36 may be of any suitable cross-sectional shape, and are usually made so as to provide the channels with the maximum cross-sectional area within the space available. In the preferred embodiment illustrated, the channels 36 are approximately semi-circular, since this results in a good combination of maximizing cross-sectional area and at the same time minimizing resistance to flow of the dielectric adhesive material along the channels.

The end wall 38 of the housing 20 is provided with a pair of chamfered injection apertures 40 which are roughly aligned with the flow channels 36. These apertures provide access through the end wall 38 of the housing 20 for injecting dielectric material into the housing. The centers of the injection apertures 40 are preferably located inside the circular array of conductors. This insures that when a dispenser nozzle is pressed against the chamfered openings of the injection apertures 40 the base will be positively seated in a correct non-tilted position flush against the disk 15 of the stem 12.

The housing 20 also preferably includes, at its distal end 23, wall portions 42 which surround the channel openings and extend from the end wall 38 a short distance along the channels. These walls serve as dams around the flow channels at the injection apertures 40 so that dielectric material injected thereinto will be impeded from excessively spreading over and around the end of the exhaust tubulation 16 in the distal end of the housing 20. This, along with the rough alignment of the apertures 40 with the channels 36, helps to initiate flow of the dielectric adhesive into and along the channels 36 in the region of the distal end 23 where the tubulation is of smaller diameter and hence farther spaced from the housing wall. Adequate clearance is provided within the housing 20 for the wall dams 42 by virtue of the tapered end of the tubulation 16 in that region.

Alternatively, the special aligned injection apertures 40 and wall dams 42 can be omitted and a single central injection aperture (not shown) used to inject the dielectric material into the housing 20. This, however, is not preferred inasmuch as the dielectric adhesive material will thus be potted completely around the end of the tubulation 16 before it seeks the preferential flow channels 36 for its continued path along the housing and into the recess 32.

The tubulation 16 is dimensioned relative to the housing 20 such that very small clearance 46 is provided therebetween. This serves to discourage flow of dielectric adhesive material down along the tubulation at all points therearound and instead encourages flow along the preferential flow channels 36. The closeness of the clearance is determined by conventional manufacturing tolerances of the housing 20 and the tubulation 16. The closer this fit, the better the preference for flow of the dielectric material along the channels 36. However, this fit cannot be made so close that manufacturing tolerances would ever result in a tubulation being too large to fit within its housing 20.

In one specific embodiment the following design dimensions were used.

| | |
|---|---|
| OD of tube neck 10 | 22.5 mm |
| diameter of circle of conductors 14 | 12.0 mm |
| diameter of injection apertures 40 | 1.65 mm |
| OD of tubulation 16 | 9.14 mm |
| ID of housing wall 34 | 9.80 mm |
| diameter of flow channels 36 | 1.65 mm |

What is claimed is:

1. A base member adapted to be disposed over an array of lead-in conductors and an exhaust tubulation of an electron tube, said base member comprising:

a. a tubular housing having an open proximal end for receiving said exhaust tubulation therein and a closed distal end, b. a flange extending outwardly from said housing at said proximal end, c. an array of apertures through said flange for receiving said array of conductors therethrough, d. a recess in said flange communicating with said open end and encompassing at least one of said apertures, e. an adhesive injection aperture through the wall of said housing at its distal end, and f. an open longitudinal channel in the internal surface of said tubular housing communicating with said injection aperture and extending from near said distal end of said housing to said recess, wherein said housing has an internal diameter which is only slightly larger than the external diameter of said exhaust tubulation, whereby said tubulation is received in said housing in a relatively close manufacturing tolerance fit with the resulting radial clearance being so small as to impede excessive flow of adhesive material along said tubulation from the distal end of said housing to said recess and whereby as a result thereof said channel provides a preferential flow path along the length of said housing and into said recess for adhesive material injected into said adhesive injection aperture.

2. The base member of claim 1 wherein said clearance is approximately 0.33 mm and said channel has a substantially semi-circular cross-section with a diameter of about 1.65 mm.

3. The base member of claim 1 which further comprises a silo structure disposed contiguous with and along side said housing in approximate alignment with said recess and receiving the one of said conductors which is disposed through said at least one of said apertures.

4. The base member of claim 3 wherein said housing is provided with two longitudinal channels which enter said recess at locations slightly to either side of said one conductor.

5. The base member of claim 1 wherein said wall at said distal end of said housing includes a wall portion surrounding said adhesive injection aperture and extending from said wall a short distance along said channel.

* * * * *